US008729001B2

(12) United States Patent
Himmrich et al.

(10) Patent No.: US 8,729,001 B2
(45) Date of Patent: May 20, 2014

(54) COMPOSITIONS CONTAINING SECONDARY PARAFFIN SULFONATE AND ALCOHOL ALKOXYLATE

(75) Inventors: Johannes Himmrich, Eppstein (DE); Wolfgang Walther, Kriftel (DE)

(73) Assignee: Clariant International, Ltd, Muttenz (CH)

( * ) Notice: Subject to any disclaimer, the term of this patent is extended or adjusted under 35 U.S.C. 154(b) by 0 days.

(21) Appl. No.: 13/996,375

(22) PCT Filed: Dec. 15, 2011

(86) PCT No.: PCT/EP2011/006333

§ 371 (c)(1), (2), (4) Date: Jul. 23, 2013

(87) PCT Pub. No.: WO2012/084151

PCT Pub. Date: Jun. 28, 2012

(65) Prior Publication Data

US 2013/0296219 A1 Nov. 7, 2013

(30) Foreign Application Priority Data

Dec. 22, 2010 (DE) ..... 10 2010 055 743

(51) Int. Cl.

| | |
|---|---|
| ***C11D 1/83*** | (2006.01) |
| ***C11D 1/12*** | (2006.01) |
| ***C11D 1/72*** | (2006.01) |

(52) U.S. Cl.

USPC ..... 510/156; 510/155; 510/228; 510/289; 510/290; 510/340; 510/351; 510/421; 510/422; 510/426; 510/495

(58) Field of Classification Search

USPC ..... 510/155, 156, 228, 289, 290, 340, 351, 510/421, 422, 426, 495

See application file for complete search history.

(56) References Cited

U.S. PATENT DOCUMENTS 4,017,409 A * 4/1977 Demessemaekers et al. . 510/429
4,111,854 A * 9/1978 Spadini et al. ..... 510/424

* cited by examiner

*Primary Examiner* — Charles Boyer
(74) *Attorney, Agent, or Firm* — Michael W. Ferrell

(57) ABSTRACT

The invention relates to compositions containing a) 45 to 65 wt. % of one or more secondary paraffin sulfonates with 8 to 22 carbon atoms, b) 1 to 10 wt. % of one or more alcohol alkoxylates which are produced from the reaction of alcohols R—OH, wherein R is an alkyl group with 9 to 11 carbon atoms, with alkoxylating agents selected from ethylene oxide, propylene oxide, or mixtures thereof and which contain on average 1 to 4 mol of structural units derived from the alkoxylating agents per 1 mol of structural units derived from the alcohols, and c) 25 to 52 wt. % water, in relation to the total weight of the composition in each case. The compositions can be used in an advantageous manner for producing washing and cleaning agents.

14 Claims, No Drawings

COMPOSITIONS CONTAINING SECONDARY PARAFFIN SULFONATE AND ALCOHOL ALKOXYLATE

The invention concerns aqueous compositions containing 45-65 wt % of secondary paraffinsulfonate, 1-10 wt % of alcohol alkoxylate and water.

Secondary paraffinsulfonates are well known for use as base surfactants, specifically for laundry-detergent applications, ware-cleaning products and industrial cleaners.

Secondary paraffinsulfonates are surfactants containing a random distribution of primarily one $SO_3X$ group in secondary position on the paraffin hydrocarbon chain and secondarily two or more $SO_3X$ groups in secondary position on the paraffin hydrocarbon chain. The paraffin hydrocarbon chains are primarily linear ones, being branched paraffin chains of 8 to 22 carbon atoms only to a low extent of 5 wt % or less. The X group can represent $Li^+$, $Na^+$, $K^+$, $Mg^{++}$, $Ca^{++}$, $Al^{+++}$, $NH_4^+$ and quaternary ammonium ions $[HNR^1R^2R^3]^+$, where $R^1$, $R^2$ and $R^3$ may each be independently selected from the group consisting of hydrogen, a linear or branched alkyl group having 1 to 22 carbon atoms, a linear or branched mono- or polyunsaturated alkenyl group having 2 to 22 carbon atoms, a linear monohydroxyalkyl group having 2 to 10 carbon atoms, preferably a monohydroxyethyl or monohydroxypropyl group, and a linear or branched dihydroxyalkyl group having 3 to 10 carbon atoms.

This class of surfactants is obtainable by sulfoxidation of paraffins under photochemical conditions and is commercially available, for example under the trade name Hostapur® SAS in the concentrations 30 wt %, 60 wt % and 93 wt %.

Approximately 60 wt % strength aqueous secondary paraffinsulfonate is pasty and tends to phase-separate. To prevent phase separation, it has to be permanently stirred or recirculated. Additives are therefore sought to suppress phase separation and thereby obviate the energy-intensive stirring or pumping operation for avoiding phase separation.

It is known that the addition of 5 to 10 wt % of ethanol or i-propanol to approximately 60 wt % strength aqueous secondary paraffinsulfonate eliminates phase separation. Disadvantageously, however, the preparation is flammable and appropriate safety precautions have to be taken.

The problem addressed by the present invention was therefore that of providing compositions having a high proportion of secondary paraffinsulfonate which do not exhibit phase separation even in the course of prolonged storage and in the event of major temperature fluctuations and do not contain flammable components.

We have found that, surprisingly, this problem is solved by compositions containing a) 45 to 65 wt % of one or more secondary paraffinsulfonates having 8 to 22 carbon atoms, b) 1 to 10 wt % of one or more alcohol alkoxylates which are prepared from the reaction of alcohols R—OH, where R is an alkyl of 9 to 11 carbon atoms, with alkoxylating agents selected from ethylene oxide, propylene oxide or mixtures thereof, and which contain in a molar average from 1 to 4 mol of structural units derived from the alkoxylating agents per 1 mol of structural units derived from the alcohols, and c) 25 to 52 wt % of water, all based on the overall weight of the compositions.

The present invention accordingly provides compositions containing a) 45 to 65 wt % of one or more secondary paraffinsulfonates having 8 to 22 carbon atoms, b) 1 to 10 wt % of one or more alcohol alkoxylates which are prepared from the reaction of alcohols R—OH, where R is an alkyl of 9 to 11 carbon atoms, with alkoxylating agents selected from ethylene oxide, propylene oxide or mixtures thereof, and which contain in a molar average from 1 to 4 mol of structural units derived from the alkoxylating agents per 1 mol of structural units derived from the alcohols, and c) 25 to 52 wt % of water, all based on the overall weight of the compositions.

Not only the secondary paraffinsulfonates of component a) but also the alcohol alkoxylates of component b) are obtainable by methods familiar to a person skilled in the art or commercially available.

The compositions of the present invention are very phase-stable. They remain phase-stable over a period of 6 or more months, preferably in a temperature range of 5 to 40° C. They are ecologically compatible, substantially odor-neutral and preferably have a homogeneous appearance.

The viscosity of compositions according to the present invention at 20° C. is preferably in the range from 1000 to 100 000 mPa·s, more preferably in the range from 2000 to 70 000 mPa·s and even more preferably in the range from 5000 to 60 000 mPa·s. The viscosities are measured on the compositions of the present invention themselves under the following conditions: Brookfield RVT instrument; spindle No. 3 for the viscosity range from 1000 to 5000 mPa·s, spindle No. 4 for the viscosity range from >5000 to 10 000 mPa·s and spindle No. 7 for the viscosity range from >10 000 to 100 000 mPa·s; 20 revolutions per minute and 20° C.

The compositions of the present invention are advantageously pumpable.

Preferably, the compositions of the present invention contain a) 45 to 65 wt % of one or more secondary paraffinsulfonates having 8 to 22 carbon atoms, b) 1 to 7 wt % of one or more of the alcohol alkoxylates, and c) 28 to 51 wt % of water, all based on the overall weight of the compositions.

More preferably, the compositions of the present invention contain a) 45 to 65 wt % of one or more secondary paraffinsulfonates having 8 to 22 carbon atoms, b) 3 to 5 wt % of one or more of the alcohol alkoxylates, and c) 30 to 50 wt % of water, all based on the overall weight of the compositions.

Preferably, the compositions of the present invention contain in addition to components a) to c)

d) sodium sulfate and e) one or more paraffins having 8 to 22 carbon atoms.

Among these compositions, preference is in turn given to those which contain d) said sodium sulfate in amounts of 1 to 5 wt % and e) the one or more paraffins having 8 to 22 carbon atoms in amounts of 0.1 to 2 wt %, all based on the entire weight of the compositions.

In a preferred embodiment of the invention, the compositions of the present invention consist of said components a) to e).

Preferably not less than 95 wt % and more preferably not less than 97 wt % of the one or more secondary paraffinsulfonates of component a) contain from 13 to 17 carbon atoms.

Preferably, from 95 to 100 wt % and more preferably from 96 to 99.9 wt % of the one or more secondary paraffinsulfonates of component a) contain a linear paraffin moiety and from 0 to 5 wt %, more preferably 0.1 to 4 wt %, of the one or more secondary paraffinsulfonates of component a) contain a branched paraffin moiety.

Preferably, the counter-ions of the one or more secondary paraffinsulfonates of component a) are selected from the group consisting of $Na^+$, $K^+$, $Mg^{2+}$ and $Ca^{2+}$. More preferably, the counter-ion of the one or more secondary paraffinsulfonates of component a) is $Na^+$.

Preferably, from 99.5 to 100 wt % of the one or more secondary paraffinsulfonates of component a) contain a saturated paraffin moiety and from 0 to 0.5 wt % of the one or more secondary paraffinsulfonates of component a) contain an unsaturated paraffin moiety. More preferably, 100 wt % of the one or more secondary paraffinsulfonates of component a) contain a saturated paraffin moiety and no unsaturated fractions.

In the context of the present invention "secondary paraffinsulfonate" is to be understood as meaning that the sulfonate groups are attached to the nonterminal paraffin moiety.

Preferably, the sulfonate groups are randomly distributed across the nonterminal paraffin moiety of the one or more secondary paraffinsulfonates of component a) and from 75 to 95 wt % of the one or more secondary paraffinsulfonates bear one sulfonate group and from 5 to 25 wt % of the one or more secondary paraffinsulfonates bear two or more sulfonate groups.

The R moiety of the alcohols R—OH which are used for preparing the alcohol alkoxylates of component b) can be linear or branched or else be mixtures of linear and branched alkyl groups. In the latter case, therefore, a mixture of alcohols R—OH having linear and branched alkyl groups R is used for preparing the alcohol alkoxylates of component b).

Preferably, the R moiety of the alcohols R—OH which are used for preparing the alcohol alkoxylates of compounds b) is a mixture of linear and branched alkyl groups. More preferably, the molar ratio of linear to branched alkyl groups is from 30:70 to 70:30 and even more preferably from 40:60 to 60:40.

The R moiety of the alcohols R—OH which are used for preparing the alcohol alkoxylates of component b) is preferably an alkyl moiety of 11 carbon atoms.

Preferably, the one or more alcohol alkoxylates of component b) are selected from alcohol ethoxylates.

The alcohol alkoxylates of component b) are obtained by reaction of alcohols with alkoxylating agents. Alcohol alkoxylates are mixtures of various compounds of differing degree of alkoxylation. The alcohol alkoxylates of component b) always contain alkoxylated compounds. But they can also contain fractions of nonalkoxylated alcohols R—OH.

Therefore, in the context of the present invention, the "alcohol alkoxylates" of component b) are mixtures of compounds containing alkoxylated alcohols having 1 to 4 mol of structural units derived from the alkoxylating agents per 1 mol of structural units derived from the alcohols, but in addition also nonalkoxylated alcohols R—OH and alkoxylated alcohols which can contain more than 4 mol of structural units derived from the alkoxylating agents per 1 mol of structural units derived from the alcohols. The alcohol alkoxylates of component b), however, contain in the molar average from 1 to 4 mol of structural units derived from the alkoxylating agents per 1 mol of structural units derived from the alcohols R—OH.

The fraction of nonalkoxylated alcohols R—OH in the alcohol alkoxylates of component b) is preferably <50 wt %, more preferably <40 wt %, even more preferably <30 wt % and yet even more preferably <25 wt %, all based on the entire component b).

The fraction of alkoxylated alcohols containing more than 4 mol of structural units derived from the alkoxylating agents per 1 mol of structural units derived from the alcohols in the alcohol alkoxylates of component b) is preferably <35 wt %, more preferably <32 wt %, even more preferably <30 wt % and yet even more preferably <25 wt %, all based on the entire component b).

The actually alkoxylated compounds of the alcohol alkoxylates of component b) of the compositions according to the present invention are preferably selected from compounds containing 1 to 30, more preferably 1 to 25 and even more preferably 1 to 20 structural units derived from the alkoxylating agents.

Preferably, the alcohol alkoxylates of component b) of the compositions according to the present invention contain in the molar average 3 mol of structural units derived from the alkoxylating agents per 1 mol of structural units derived from the alcohols.

More preferably, the one or more alcohol alkoxylates comprise a $C_{11}$ oxo process alcohol ethoxylate having in the molar average 3 mol of ethylene oxide units per 1 mol of $C_{11}$ oxo process alcohol.

The pH of compositions according to the present invention is preferably in the range from 6.0 to 9.0 and more preferably in the range from 7.0 to 8.5.

The compositions of the present invention are obtainable by said components a) to c) and optionally d) and e) (and optionally further components) being mixed together at room temperature or at elevated temperatures, preferably at temperatures to 80° C., under agitation. Preferably, component a) is initially charged in water, which is component c), optionally together with components d) and e) and component b) is added under agitation. This may preferably take the form of the alcohol alkoxylate being added directly following the synthesis and workup of the secondary paraffinsulfonate, which is typically synthesized in water.

The compositions of the present invention are very useful in the manufacture of washing and cleaning products. The present invention accordingly further provides for the use of a composition according to the present invention in the manufacture of washing and cleaning products.

The washing and cleaning products obtainable from the compositions of the present invention are preferably dishwashing detergents, preferably manual dishwashing detergents, liquid laundry detergents, hard surface cleaners, for example for cleaning ceramic, metal or glass surfaces, neutral cleaners, all-purpose cleaners, sanitary cleaners, floor cleaners, industrial cleaners, but also washing and cleaning products in pulverulent form.

The amounts in which the compositions of the present invention are present in the washing and cleaning products obtained therefrom are preferably in the range from 0.5 to 60.0 wt % and more preferably in the range from 2.0 to 50.0 wt %. These quantitative particulars are based on the overall weight of the final washing and cleaning product.

The compositions of the present invention can be used not only in acidic but also in basic formulations, preferably in formulations having a pH of 2 to 13. The compositions of the present invention have the advantage that they are stable at these pH values.

The compositions of the present invention are further very useful in the manufacture of cosmetic cleaning products such as, for example, shampoos, shower gels, foam baths, soaps and dentifrices.

The compositions of the present invention are further very useful as antistatics for plastics, as auxiliaries for emulsion polymerizations, as textile and leather auxiliaries, for use in fire extinguishants and for use as oil field chemicals.

The examples which follow are offered by way of elucidation, not limitation of the invention. All percentages are weight percent (wt %), unless explicitly stated otherwise.

EXAMPLE A

Inventive compositions of Examples A1 to A5 and also of Comparative Examples V-1 and V-2 were prepared and visually evaluated with regard to their appearance, phase stability and consistency. The influence of the amount of alcohol alkoxylate was investigated. The results are reported in table A.

TABLE A

Visual evaluation of various compositions

| Example | Hostapur ® SAS 60 [wt %] | Genapol ® UD 030 [wt %] | Evaluation |
|---|---|---|---|
| A1 | 96.0 | 4.0 | milky, phase stable |
| A2 | 95.0 | 5.0 | milky, phase stable |
| A3 | 94.0 | 6.0 | milky, phase stable |
| A4 | 93.0 | 7.0 | milky, phase stable |
| A5 | 92.0 | 8.0 | milky, phase stable |
| V-1 (comparator) | 99.5 | 0.5 | phase separation, sediment, clear supernatant |
| V-2 (comparator) | 88.0 | 12.0 | phase separation, sediment, clear supernatant |

Method of Making:

Hostapur® SAS 60 is initially charged and the Genapol® UD 030 is added at room temperature under agitation which is subsequently continued for 5 minutes.

Hostapur® SAS 60 is a composition of secondary sodium paraffinsulfonate (about 60 wt %) in water. The secondary paraffinsulfonate used contains about 97 wt % of paraffinsulfonates having 13 to 17 carbon atoms. The n-paraffin fraction of the secondary paraffinsulfonate is >98 wt %. The secondary paraffinsulfonate is 100% saturated. It comprises about 90 wt % of monosulfonated and about 10 wt % of disulfonated and more highly sulfonated paraffinsulfonates.

Genapol® is a $C_{11}$-oxoalcohol ethoxylate having in the molar average 3 mol of ethylene oxide units per 1 mol of $C_{11}$ oxo process alcohol. $C_{11}$ oxo process alcohol moiety in Genapol® UD 030 represent a mixture of linear and branched alkyl groups with a molar ratio of linear to branchednalkyl groups of about 50:50. The active content in Genapol® UD 030 is 100%.

Compositions A1-A5, V-1 and V-2 were evaluated for phase stability by storing the compositions for 6 months while alternating between 12 hours at a temperature of 40° C. and 12 hours at a temperature of 5° C. A reported phase separation, however, does not mean that this phase separation only occurred after 6 months.

The results in Table A reveal that Inventive Examples A1 to A5 are phase-stable compositions. By contrast, the composition of Comparative Example V-1, which contains a small amount of Genapol® UD 030, gave rise to phase separation. The same happened with the composition of Comparative Example V-2, which contains a higher amount of Genapol® UD 030.

Adding Genapol® UD 030 has the effect of reducing the viscosity of Hostapur® SAS 60 in the compositions of Inventive Examples A1-A5. These compositions have such viscosities that they are readily pumpable using commercially available pumps.

EXAMPLE B

Comparative Examples V-3 and V-4 were prepared and visually evaluated with regard to their phase stability. The influence of the type of alcohol alkoxylate was investigated. The results are reported in Table B.

TABLE B

Visual evaluation of various compositions

| Example | Hostapur ® SAS 60 [wt %] | Alcohol alkoxylate [wt %] | Evaluation |
|---|---|---|---|
| V-3 (comparator) | 95.0 | $C_{12-15}$ alcohol, 3 EO [5.0 wt %] | phase separation |
| V-4 (comparator) | 95.0 | $C_{11}$ alcohol, 5 EO [5.0 wt %] | phase separation |

Method of Making:

Hostapur® SAS 60 is initially charged and the alcohol alkoxylate is added at room temperature under agitation which is subsequently continued for 5 minutes.

$C_{12-15}$ Alcohol, 3 EO is a $C_{12-15}$ oxo process alcohol ethoxylate having in the molar average 3 mol of ethylene oxide units per 1 mol of $C_{12-15}$ oxo process alcohol.

$C_{11}$ Alcohol, 5 EO is a $C_{11}$ oxo process alcohol ethoxylate having in the molar average 5 mol of ethylene oxide units per 1 mol of $C_{11}$ oxo process alcohol.

The compositions V-3 and V-4 were evaluated for phase stability as described in Example A.

The results in Table B reveal that the compositions of Comparative Examples V-3 and V-4, which contain an alcohol alkoxylate other than in component b) of the inventive compositions, give rise to phase separation. By contrast, the result for Inventive Example A2 from Table A reveals that use of the same amount of an alcohol alkoxylate which, however, corresponds to component b) of the inventive compositions, gives phase-stable compositions.

FORMULATION EXAMPLES

Formulations follow which were prepared using compositions of the present invention.

Formulation 1: Dishwashing Composition

| | | |
|---|---|---|
| A | Genapol ® LRO paste (Clariant) active ingredient: lauryl ether sulfate, 2EO (EO: ethylene oxide unit), sodium salt | 25.0 wt % |
| B | Ethanol | 7.5 wt % |
| C | Composition of Example A4 | 30.0 wt % |
| D | Distilled water | ad 100 wt % |
| E | Genaminox ® LA (Clariant) active ingredient: lauryldimethylamine oxide | 25.0 wt % |
| F | Scent, colorant, preservative | q.s. |

Method of Making:

Successive addition to A of components B to F at room temperature under agitation.

Formulation 2: All-Purpose Cleaner

| | | |
|---|---|---|
| A | Distilled water | ad 100 wt % |
| | coconut fatty acid | 2.0 wt % |
| | potassium hydroxide (85 wt % strength) | 0.5 wt % |
| B | Composition of Example A3 | 10.0 wt % |
| | Genapol ® UD 080 (Clariant) | 8.0 wt % |
| | active ingredient: undecyl alcohol polyglycol ether, 8 EO | |
| C | Trisodium citrate | 1.0 wt % |

Method of Making:

I Dissolve components of A in water at 40 to 50° C.

II Add B to I under agitation

III Add C to II

Formulation 3: Neutral Soap

| | | |
|---|---|---|
| A | Genapol ® LRO liquid (Clariant) | 42.8 wt % |
| | active ingredient: lauryl ether sulfate, 2EO, sodium salt | |
| | composition of Example A2 | 10.0 wt % |
| | Genapol ® OA 070 (Clariant) | 5.0 wt % |
| | active ingredient: $C_{14}/C_{15}$ oxo process alcohol polyglycol ether, 7EO | |
| | Genapol ® TSM (Clariant) | 3.0 wt % |
| | active ingredient: alkyl ether sulfate | |
| B | Genagen ® CAB 818 (Clariant) | 10.0 wt % |
| | active ingredient: $C_7/C_{17}$ alkylamidopropylbetaine | |
| | water | ad 100 wt % |
| | scent, colorant, preservative | q.s. |
| C | Sodium chloride | 0.7 wt % |

Method of Making:

I Mix A components at room temperature

II Add B and C components to I

III Homogenize

Formulation 4: Liquid Laundry Detergent

| | | |
|---|---|---|
| A | Genapol ® OA 080 (Clariant) | 12.0 wt % |
| | active ingredient: $C_{14}/C_{15}$ oxo process alcohol polyglycol ether, 8EO | |
| B | Prifac ® 7949 (Unichema Chemie GmbH) | 14.0 wt % |
| | active ingredient: fatty acid mixture | |
| | potassium hydroxide (85 wt % strength) | 2.6 wt % |
| | triethanolamine | 2.0 wt % |
| | 1,2-propanediol | 5.0 wt % |
| C | Water | ad 100 wt % |
| D | Trisodium citrate dihydrate | 5.0 wt % |
| | composition of Example A1 | 17.0 wt % |
| | Dequest 2066 (Monsanto) | 4.0 wt % |
| | active ingredient: organophosphonate | |
| E | Ethanol | 3.0 wt % |
| | Savinase ® (Novo) | 0.5 wt % |
| | Alcalase ® (Novo) | 0.2 wt % |
| | Termamyl ® (Novo) | 0.3 wt % |
| | Savinase ® (Novo) | 0.3 wt % |
| | colorant, scent, preservative | q.s. |

Method of Making:

I Successive addition of B components to A under agitation at room temperature

II Addition of component C, heated to 50° C., to I under agitation and dissolving III Successive addition of D components to II under agitation IV Cooling down to room temperature V Addition of E components to IV under agitation The constituents of the formulations in the formulation examples were used in the amounts as reported, so for example the quantitative particulars relate to the employed commercial products as such and not to the active ingredients therein.

What is claimed is:

1. A composition containing a) 45 to 65 wt % of at least one secondary paraffinsulfonate having 8 to 22 carbon atoms, b) 1 to 10 wt % of at least one alcohol alkoxylate which are prepared from the reaction of alcohols R—OH, where R is an alkyl of 9 to 11 carbon atoms, with alkoxylating agents selected from ethylene oxide, propylene oxide or mixtures thereof, and which contain in a molar average from 1 to 4 mol of structural units derived from the alkoxylating agents per 1 mol of structural units derived from the alcohols, and c) 25 to 52 wt % of water, all based on the overall weight of the composition.

2. The composition as claimed in claim 1 containing a) 45 to 65 wt % of at least one secondary paraffinsulfonate having 8 to 22 carbon atoms, b) 1 to 7 wt % of at least one alcohol alkoxylate, and c) 28 to 51 wt % of water, all based on the overall weight of the composition.

3. The composition as claimed in claim 1 containing a) 45 to 65 wt % of at least one secondary paraffinsulfonate having 8 to 22 carbon atoms, b) 3 to 5 wt % of at least one alcohol alkoxylate, and c) 30 to 50 wt % of water, all based on the overall weight of the composition.

4. The composition as claimed in claim 1, containing in addition to components a) to c)

d) sodium sulfate and e) at least one paraffin having 8 to 22 carbon atoms.

5. The composition as claimed in claim 4 containing d) sodium sulfate in amounts of 1 to 5 wt % and e) the at least one paraffin having 8 to 22 carbon atoms in amounts of 0.1 to 2 wt %, all based on the entire weight of the composition.

6. The composition as claimed in claim 4 consisting of components a) to e).

7. The composition as claimed in claim 1, wherein not less than 95 wt % of the at least one secondary paraffinsulfonate of component a) contains from 13 to 17 carbon atoms.

8. The composition as claimed in claim 1, wherein from 95 to 100 wt % of the at least one secondary paraffinsulfonateof component a) contains a linear paraffin moiety and from 0 to 5 wt % of the at least one secondary paraffinsulfonate of component a) contains a branched paraffin moiety.

9. The composition as claimed in claim 1, wherein the counter-ions of the at least one secondary paraffinsulfonate of component a) is selected from the group consisting of $Na^+$, $K^+$, $Mg^{2+}$ and $Ca^{2+}$.

10. The composition as claimed in claim 9 wherein the counter-ion of the at least one secondary paraffinsulfonate of component a) is $Na^+$.

11. The composition as claimed in claim 1, wherein 100 wt % of the at least one secondary paraffinsulfonate of component a) contains a saturated paraffin moiety.

12. The composition as claimed in claim 1, wherein the sulfonate groups are randomly distributed across the nonterminal paraffin moiety of the at least one secondary paraffinsulfonate of component a) and from 75 to 95 wt % of the at least one secondary paraffinsulfonate bears one sulfonate group and from 5 to 25 wt % of the at least one secondary paraffinsulfonate bears two or more sulfonate groups.

13. The composition as claimed in claim 1, wherein the at least one alcohol alkoxylate of component b) is selected from alcohol ethoxylates.

14. A process for the manufacture of washing and cleaning product comprising the step of adding at least one composition according to claim 1 to the washing and cleaning product.

* * * * *